United States Patent [19]

Croucher et al.

[11] Patent Number: 4,789,616

[45] Date of Patent: Dec. 6, 1988

[54] PROCESSES FOR LIQUID DEVELOPER COMPOSITIONS WITH HIGH TRANSFER EFFICIENCIES

[75] Inventors: Melvin D. Croucher, Oakville; Raymond W. Wong, Mississauga, both of Canada; Christopher K. Ober, Ithaca, N.Y.; Michael L. Hair, Oakville, Canada

[73] Assignee: Xerox Corporation, Stamford, Conn.

[21] Appl. No.: 118,904

[22] Filed: Nov. 9, 1987

[51] Int. Cl.[4] ..... G03G 9/12

[52] U.S. Cl. ..... 430/137

[58] Field of Search ..... 430/137

[56] References Cited

U.S. PATENT DOCUMENTS 3,766,072 10/1973 Metcalfe et al. .
4,032,463 6/1977 Kawanishi et al. .
4,085,058 4/1978 Adachi et al. .
4,120,805 10/1978 Yamashita et al. .
4,157,974 6/1979 Brechlin et al. .
4,476,210 10/1984 Croucher et al. ..... 430/137 X
4,617,249 10/1986 Ober et al. ..... 430/137

FOREIGN PATENT DOCUMENTS 58-62656 4/1983 Japan ..... 430/137

*Primary Examiner*—Roland E. Martin
*Attorney, Agent, or Firm*—E. O. Palazzo

[57] ABSTRACT

A process for the preparation of liquid developer compositions containing dyed polymer particles with an average diameter of from about 2 to about 6 microns, which particles are dispersed in an oil base, charge control additives, and stabilizers thereby permitting image transfer efficiencies exceeding 80 percent, which comprises formulating polymer particles by dispersion polymerization in a mixture comprised of a first oil base solvent, and a second solvent with a higher volatility than said first solvent, and further containing an amphipathic steric stabilizer; thereafter dyeing the product resulting; followed by removal of the more volatile second solvent; and subsequently adding to the dyed product a charge control additive.

16 Claims, No Drawings

PROCESSES FOR LIQUID DEVELOPER COMPOSITIONS WITH HIGH TRANSFER EFFICIENCIES

BACKGROUND OF THE INVENTION

This invention is generally directed to processes for the preparation of developer compositions, especially liquid developers with excellent transfer efficiencies. More specifically, the present invention is directed to a process for the preparation of liquid developer compositions containing dyed polymeric particles with an average diameter of from about 2 to about 6 microns which comprises initially formulating a latex dispersion, thereafter dyeing the dispersion, and subsequently adding to the resulting dispersion components such as charge directors. Thus, in one important embodiment of the present invention there is provided a process for the preparation of liquid ink compositions with excellent transfer efficiencies, exceeding 80 percent (percent by weight of the ink composition developed on the photoreceptor and transferred, for example, to paper) or greater, which comprises the formation in a solvent mixture of a latex dispersion by polymerization, thereafter dyeing the product, and subsequently generating a liquid ink by adding thereto components such as charge directors. The liquid inks of the present invention can be selected for the development of images in various processes, including the liquid development process as described in U.S. Pat. No. 3,084,043, the disclosure of which is totally incorporated herein by reference; xerographic processes, electrographic recording, electrostatic printing, and facsimile systems; color proofing processes; and the process as illustrated in Savin British Patent Publication No. 2,169,416, published July 9, 1986, the disclosure of which is totally incorporated herein by reference.

Development of electrostatic latent images with liquid developer compositions comprised of, for example, a dispersion of pigments in a liquid hydrocarbon is known. In these methods, the electrostatic latent image, which is usually formulated on a single sheet of photoconductive paper, such as zinc oxide, is transported through a bath of the aforementioned liquid developer. Contact with the liquid developer causes the charged pigment particles present therein to migrate through the liquid to the zinc oxide sheet in the configuration of a charged image. Thereafter, the sheet is withdrawn from the liquid developer bath with the charged pigment particles adhering to the electrostatic latent image in image configuration. The thin film of residual developer remaining on the surface of the sheet is then evaporated within a relatively short time period, usually less than 5 seconds. Also, the marking pigment particles may be fixed to the sheet by heat, for example, in image configuration.

There are disclosed in U.S. Pat. No. 3,554,946 liquid developers for electrophotography comprised of a carrier liquid consisting of a hydrocarbon, negatively electrostatically charged toner particles dispersed in the carrier liquid, and a pigment therein such as carbon black, aniline black, prussian blue, phthalocyanine red, and cadmium yellow. In accordance with the teachings of this patent, a copolymer is coated on the surface of the pigment particles for the primary purpose of imparting a negative electrostatic charge to these particles. Other patents disclosing similar liquid developer compositions include U.S. Pat. Nos. 3,623,986; 3,625,897; 3,900,412; 3,976,583; 4,081,391 and 3,900,412. In the '412 patent there is specifically disclosed a stable developer comprised of a polymer core with a steric barrier attached to the surface of the polymer selected. In column 15 of this patent there are disclosed colored liquid developers by selecting pigments or dyes, and physically dispersing them by ball milling or high shear mixing. Attempts to obtain useful color liquid developer compositions by the ball milling process described have been substantially ineffective, particularly with respect to obtaining developed images of acceptable optical density in that, for example, the desired size for the latex particles is from 0.2 to 0.3 micron in diameter; and with ball milling techniques it is very difficult to provide a dispersion of carbon black or other pigment particles much smaller in size than about 0.7 to about 0.8 micron. Consequently, the addition of carbon black pigment particles, for example, to latex particles with a diameter of 0.2 to 0.3 micron, while ball milling would result in relatively small latex particles residing on the surface of the pigment particles. In contrast with the invention of the present application, there are obtained dyed polymer particles with an average diameter of from about 2 to about 6 microns permitting high transfer efficiencies since these larger particles do not migrate from the image during transfer as is the situation with submicron particles, and also the larger particles are not as strongly held to the photoreceptor surface.

Additionally, there are described in U.S. Pat. No. 4,476,210, the disclosure of which is totally incorporated herein by reference, liquid developers containing an insulating liquid dispersion medium with submicron size marking particles therein, which particles are comprised of a thermoplastic resin core substantially insoluble in the dispersion, an amphipathic block or graft copolymeric stabilizer irreversibly chemically or physically anchored to the thermoplastic resin core, and a colored dye imbibed in the thermoplastic resin core. The history and evolution of liquid developers is provided in the '210 patent, reference columns 1 and 2 thereof.

In addition, there are illustrated in the aforementioned British Patent Publication No. 2,169,416 liquid developer compositions comprising toner particles associated with a pigment dispersed in a nonpolar liquid, and wherein the toner particles are formulated with a plurality of fibers or tendrils from a thermoplastic polymer, and carry a charge of polarity opposite to the polarity of the latent image. These toners apparently permit in some instances excellent transfer efficiencies, however, they are difficult to prepare, batch to batch reproducibility is difficult to obtain; and further in some instances the resulting inks do not possess acceptable transfer of the image. It is believed that some of the aforementioned disadvantages occur since the particles are prepared by an attrition process, where the particle size and size distribution is difficult to control as compared to a chemical process.

Furthermore, there is illustrated in copending U.S. application Ser. No. 846,164, entitled Black Liquid Developer Composition, the disclosure of which is totally incorporated herein by reference, stable black submicron liquid developer comprised of an insulating liquid medium having dispersed therein black marking particles comprised of a thermoplastic resin core which is substantially insoluble in the dispersion medium, and chemically or physically anchored to the resin core an amphipathic block or graft copolymer steric stabilizer which is soluble in the dispersion medium; and wherein dyes comprised of a specific mixture are imbibed in the thermoplastic resin core with the mixture of dyes being dispersible at the molecular level, and therefore soluble in the thermoplastic resin core and insoluble in the dispersion medium.

Other patents of interest include U.S. Pat. No. 4,210,805, which discloses toner particles prepared by adding a solvent solution of polyvinylcarbazole to Isopar® wherein the diameter of the particles is a function of the ratio of solvent to Isopar®, reference column 8; U.S. Pat. No. 4,032,463 which illustrates that the ratio of toluene to Isopar® effects toner resin particle size; and U.S. Pat. No. 3,766,072 which appears to disclose that resin solvency in the vehicle effects the particle size. Also, in the '463 and '072 patents it is indicated that a solvency increase of the dispersion medium provides a larger final size particle. This occurs, it is believed, because one of the liquids used in formulating such developers is a solvent for the resin that is used. Consequently, the particle will be swollen by the entrapped solvent in the particle yielding a larger particle size. Also, in the polymerization process changing the solvent/nonsolvent ratio of the dispersion medium changes the kinetics and thus the mechanism by which particles are formed. With latex particle polymerization, usually only submicron size particles are envisioned, reference for example "Dispersion Polymerization in Organic Media", ed. K. E. J. Barret, Academic Press, 1975.

Although the above described liquid inks and the processes thereof are suitable for their intended purposes, there remains a need for simple processes that will enable liquid developers containing dyed polymeric particles with a size diameter of from about 2 to about 6 microns thereby permitting the advantages illustrated herein. More specifically, there is a need for processes for obtaining liquid developers containing dyed polymeric particles with a size diameter of from about 2 to about 6 microns, which developers possess superior transfer efficiencies, and desirable conductivity values. There also is a need for colored liquid developers containing dyed polymeric particles with a size diameter of from about 2 to about 6 microns, which possess many of the aforementioned characteristics. Additionally, there is a need for economical liquid developer compositions that permit images of excellent resolution in a number of known imaging processes, including those illustrated in U.S. Pat. No. 3,084,043. Moreover, there is a need for processes for liquid developers wherein the colorants selected are suitable dispersed thus enabling black, or colored images of excellent resolution. Further, there remains a need for liquid developer processes wherein there is included therein certain steric stabilizers that stabilize the developer particles, and wherein these developers permit wetting of the photoreceptor surface thus permitting transfer efficiencies of 80 percent or greater.

SUMMARY OF THE INVENTION

It is an object of the present invention to provide processes for the preparation of liquid developer compositions.

In another object of the present invention there are provided processes for the preparation of liquid developer compositions containing dyed polymeric particles with an average diameter of from about 2 to about 6 microns.

In yet another object of the present invention there are provided processes for liquid developer compositions with superior transfer efficiencies, which inks include stabilizers therein.

It is an additional object of the present invention to provide processes for liquid developer compositions with transfer efficiencies of 80 percent or greater.

Furthermore, in another object of the present invention there are provided processes for liquid developer compositions with black, cyan, magenta or yellow dyes therein.

Additionally, in another object of the present invention there are provided processes for ink compositions with extended shelf life, and wherein these compositions are free of environmental hazards.

In addition, in another object of the present invention there are provided processes for ink compositions that can be readily cleaned from photoreceptor surfaces, especially since less ink is present on these surfaces subsequent to transfer, which inks are formulated from a solvent mixture.

Moreover, there is a need for processes for obtaining ink compositions that are useful in various development systems, inclusive of electrostatic, printing, color proofing methods, and the like.

These and other objects of the present invention are accomplished by providing processes for liquid toner compositions. More specifically, in one embodiment the present invention is directed to processes for liquid developer compositions containing dyed polymeric particles with a diameter of from about 2 to about 6 microns with substantially no submicron size particles present, and with transfer efficiencies of 80 percent or greater. In one embodiment of the present invention the process comprises the preparation of a latex mixture, thereafter dyeing the mixture, and subsequently adding thereto charge control additives. The latex mixture can be prepared, for example, by dissolving a steric stablizer mixture of solvents, such as toluene/Isopar® oil base mixture, followed by the addition of a monomer or comonomers, and a thermally activated free radical polymerization initiator. Subsequent to polymerization, there results latex particles of an average diameter size of about 2 microns, which particle size can be modified to up to at least 6 microns by varying the ratio of the toluene/Isopar® mixture. Thereafter, the dyed latex is formulated into an ink by removing the more volatile solvent by, for example, heating under reduced pressure and adding thereto additive components, inclusive of charge control materials, such as zirconium octoate.

Accordingly, in an embodiment of the present invention there is provided a process for the preparation of liquid developer compositions containing dyed polymer particles with an average diameter of from about 2 to about 6 microns, which particles are dispersed in an oil base, charge control additives, and stabilizers thereby permitting image transfer efficiencies exceeding 80 percent, which comprises formulating polymer particles by dispersion polymerization in a mixture comprised of a first oil based solvent, and a second solvent with a higher volatility than said first solvent, and further containing an amphipathic steric stabilizer; thereafter dyeing the product resulting; followed by removal of the more volatile second solvent; and subsequently adding to the dyed product a charge control additive.

In one specific embodiment of the present invention, there are provided processes for formulating liquid developer compositions comprised of from about 90 percent to about 99.5 percent by weight of a first oil base solvent illustrated herein, from about 0.5 percent to about 6 percent by weight of black or colored dyed polymer particles, from about 0.01 to about 2 percent by weight of charge control additives, and from about 0.5 to about 4 percent by weight of stabilizers, inclusive of polyisobutylene, poly(2-ethyl hexyl methacrylate), and a poly(styrene-b-hydrogenated butadiene) copolymer, which are physically or chemically attached to the dyed polymer particles.

Examples of oil base first solvent components present in an amount of from about 90 percent by weight to about 99.5 percent by weight, and preferably present in an amount of from about 96 percent by weight to about 99.5 percent by weight, include aliphatic hydrocarbons, such as Isopar ® G, L, M, commercially available from Exxon Corporation. Other oil base solvents include Amsco 460 solvent and Amsco OMS, both available from American Mineral Spirits Company; mineral spirits such as Soltrol, available from Phillips Petroleum; Pegasol, available from Mobile Oil; and aliphatic hydrocarbon liquids such as Shellsol, available from Shell Oil. Examples of second solvents that may be selected to enable the preparation of large micron size polymer particles include aromatic hydrocarbons such as toluene, ethyl benzene, xylene, mixtures thereof, especially with various Isopars ®; and the like. Other solvent mixtures can be selected providing they enable dissolution of the polymers that form the core of the latex particle. Generally, the solvent mixture is comprised of from about 85 to 50, and preferably 80 to 60 weight percent of the first solvent; and 15 to 50, and preferably 20 to 40 weight percent of the second more volatile solvent.

Dyed polymer particles present in an amount of from about 0.5 percent by weight to about 6 percent by weight, and preferably present in an amount of from about 0.6 percent by weight to about 3 percent by weight are selected. Illustrative examples of the polymer component of the aforementioned particles, which component is insoluble in the oil base first solvent such as Isopar ® include poly(methyl acrylate), poly(methyl methacrylate), poly(ethyl methacrylate, poly(hydroxyethyl methacrylate), poly(2-ethoxyethyl methacrylate), poly(butoxy ethoxyethyl methacrylate), poly(-butoxy ethoxyethyl methacrylates), poly(dimethyl amino ethyl acrylates), poly(acrylic acids), poly(methyacrylic acids), poly(acrylamides), poly(methacrylamides), and polystyrene. A preferred group of polymer materials are the homopolymers of methyl methacrylate, ethyl acrylate, styrene, and copolymers thereof; and thermoplastic resins selected from the group consisting of vinyl, acrylic and methacrylic resins. The mechanical properties of the ink marking particles may be altered or varied by the selection of the insoluble polymer, which comprises the latex particle. For transfer liquid toners, the mechanical properties of the particle are important since it is preferred that the particles retain their spherical shape, thus for example preventing formation of a film on the photoreceptor. Consequently, the core of the polymer particle should preferably possess a glass transition temperature greater than about 35° C.

The polymeric components are treated with a suitable organic dye to impart color to it. Generally, the organic dye is preferably dispersible at the molecular level in the synthetic polymeric resin core to provide a molecular dispersion and ensure distribution thereof since it would otherwise tend to aggregate and provide poor color intensity as well as broadened spectral characteristics. Moreover, it is preferred that the dye be water insoluble to ensure permanence of the developed image and to avoid dissolving subsequent to development should the image come into contact with water, coffee, tea and the like. Typical organic dyes that may be selected include those that are soluble in solvents like toluene, xylene and ethyl benzene, such as Orasol Yellow 2GLN (Ciba-Geigy), Hytherm Blue B100 (Morton Chemical Company), Irisol Fast Yellow GRE140 (Bayer), Ceres Blue GN(Bayer), Sudan Red 460 (BASF), and mixtures thereof.

Examples of charge control additives that may be selected for the liquid developer compositions of the present invention, and that are present in an amount of from about 0.01 percent by weight to about 2.0 percent by weight, and preferably in an amount of from about 0.02 percent by weight to about 0.1 percent by weight, are the cadmium, calcium, manganese, magnesium and zinc salts of heptanoic acid; the barium, aluminum, cobalt, manganese, zinc, cerium and zirconium salts of 2-ethyl hexanoic acid; the barium, aluminum zinc, copper, lead and iron salts of stearic acid; the calcium, copper, manganese, nickel, zinc and iron salts of naphthenic acid; and ammonium lauryl sulfate, sodium dihexyl sulfosuccinate, sodium dioctyl sulfosuccinate, aluminum diiopropyl salicylate, aluminum dresinate, and the aluminum salt of 3,5 di-t-butyl gamma resorcylic acid. Mixtures of these materials may also be used. Preferred charge control additives are zirconium octoate, which is available from Nuodex Canada, polyisobutylene succinimide, commercially available as OLOA 1200 from Chevron Chemical Company, and lecithin, commercially available from Fisher Scientific Company. The aforementioned charge control additive can impart a positive or negative charge to toner composition, which charge is dependent primarily on the interaction of the molecularly dissolved dye and the polymer particles.

The steric stabilizer selected is of importance since, for example, during the particle polymerization process its purpose is to stabilize the growing nuclei of the polymer particle in the polymerization mixture. Accordingly, it becomes irreversibly anchored to the insoluble portion of the latex particle. Typically, the steric stabilizer is composed of a copolymer, preferably a block or graft copolymer having a moiety with an affinity for, or being solvated by the solvent, for example, the oil based dispersion medium; and having a second moiety with an affinity for the synthetic resin core, and which is nominally insoluble in the oil based dispersion medium. Additionally, the steric stabilizer should be substantially completely soluble in the oil based dispersion thereby permitting the micron size particles formed to remain as discrete entities in the dispersion medium for extended periods of time. Examples of steric stabilizer copolymers that can be selected as indicated herein include poly(2-ethyl hexyl methacrylate), poly(isobutylene-co-isoprene) known as Kalene 800 from Hardman Chemical Company, New Jersey, and poly(styrene-b-hydrogenated butadiene) known as Kraton G-1701 from the Shell Chemical Company, Texas. These steric stabilizers are usually present in an amount of from between 0.5 and 10 percent by weight of the polymer particles.

Initiator components in concentrations of, for example, from 0.05 to 10 weight percent based on the weight of monomer for affecting the polymerization reaction include benzoyl peroxide, azobisisobutyonitrile, and the like.

The ink compositions of the present invention are particularly useful in liquid development system, such as those illustrated in the aforementioned British Patent Publication, and color proofing processes. More specifically, these processes involve depositing an electrostatic charge pattern on a photoreceptor or a dielectric surface, and then toning the electrostatic image with the liquid developer of the present invention, followed by electrostatically transferring to plain paper. In addition, the liquid developer compositions of the present invention are also useful for enabling the development of colored electrostatic latent images, particularly those contained on an imaging member charged positively or negatively. For a positively charged electrostatic image, a negatively charged liquid developer is selected; while for a negatively charged electrostatic image, a positively charged liquid developer is utilized to obtain a developed image. Examples of imaging members that may be selected are various known organic photoreceptors, including layered photoreceptors. Illustrative example of layered photoresponsive devices include those with a substrate, a photogenerating layer, and a transport layer as disclosed in U.S. Pat. No. 4,265,990, the disclosure of which is totally incorporated herein by reference. Examples of photogenerating layer pigments are trigonal selenium, metal phthalocyanines, metal free phthalocyanines, and vanadyl phthalocyanine. Transport material examples include various diamines dispersed in resinous binders. Other organic photoresponsive materials that may be utilized in the practice of the present invention include polyvinyl carbazole; 4-dimethylaminobenzylidene; 2-benzylidene-amino-carbazole; (2-nitrobenzylidene)-p-bromoaniline; 2,4-diphenylquinazoline; 1,2,4-triazine; 1,5-diphenyl-3-methyl pyrazoline 2-(4'-dimethyl-amino phenyl)benzoxazole; 3-amino-carbazole; polyvinyl carbazole-tritrofluorenone charge transfer complex; and mixtures thereof. Further imaging members that can be selected are selenium and selenium alloys, zinc oxide, cadmium sulfide, hydrogenated amorphous silicon, as well as ionographic surfaces of various dielectric materials, such as polycarbonate polysulfone fluoropolymers, and anodized aluminum alone or filled with wax expanded fluoropolymers.

With further respect to the process of the present invention, the stabilized, highly colored liquid developer compositions are obtained by first dissolving the amphipathic stabilizer in the liquid developer dispersion medium. An excess of a monomer or mixture of monomers from which the synthetic resin is to be formed together with a solvent, such as toluene, and a free radical initiator is then added to the stabilizer solution, followed by polymerization of the monomer to form the sterically stabilized latex. Thereafter, a solution of the dye or mixture of dyes in a mixtures of solvents for the dyes, such as aromatic hydrocarbons inclusive of xylene, is added to the dispersion to imbibe the dye into the marking particle.

During the polymerization procedure, the amphipathic steric stabilizer becomes intimately bound to the synthetic core. The expression "intimately bound" is intended to refer to chemical and physical interactions that irreversibly anchor the amphiphatic stabilizer in a manner that prevents its separation from the ink particle under normal operating conditions. Once the stabilized resin has been prepared, the dye may be imbibed in it as described hereinafter, and a charge control agent can then be added to the dispersion. The aforementioned procedure may be viewed as a four step process involving:

(1) dissolution of the amphipathic stabilizer in the first oil base solvent, and second solvent based dispersion medium;
(2) non-aqueous dispersion polymerization of the mixture monomer(s) in the presence of the amphipathic stabilizer and solvent mixture to provide the stabilized polymer particles;
(3) dyeing of the non-aqueous latex or polymer particles, and removal of the more volatile second solvent from the dispersion under reduced pressure; and
(4) adding charge control components to provide negatively or positively charged particles.

Once the stabilizer has been dissolved in the dispersion medium, the synthetic resin particle can be prepared by a non-aqueous dispersion polymerization method. This is accomplished by adding an excess of a monomer to be polymerized to the solution containing the amphipathic stabilizer, which acts as the steric stabilizer during the growth of the polymer particles, This growth takes place in the presence of a free radical initiator at atmospheric pressure and elevated temperatures of from about 60° C. to about 90° C. Over a period of from about 1 to about 20 hours, the polymer nucleus of the marking particles is grown in the presence of the steric stabilizer with the result that a dispersion is formed containing up to about 50 percent by weight of particles having a relatively uniform size. Particles in the size range of 2 microns to about 6 microns result. During the growth of the polymer core, the amphipathic polymer functions as a steric stabilizer to retain the individual growing particles separate in the dispersion. When, for example, the dispersion polymerization of monomer takes place without the stabilizer present, the polymer formed from the monomer will phase separate forming the nucleus of the particle which will then flocculate and settle as sediment in the form of an aggregate. Instead, the polymerization takes place in the presence of the stabilizer which becomes irreversibly and intimately bound either chemically or physically to the polymer particle being formed thereby providing a thermodynamically stable particle.

Also, subsequent to preparation of the stable dispersion of marking particles, they are dyed to provide a core particle capable of producing a toned image of acceptable optical density and color characteristics. The dye is molecularly incorporated into the core particles by selecting a specific dye imbibition absorption technique. It has been found that aromatic solvents may be specifically absorbed into the core of the particle produced from the non-aqueous dispersion polymerization procedure, and by dissolving a dye into such an aromatic solvent the dye is readily imbibed or absorbed into the polymer particle. Also, the dye should be soluble in the second aromatic solvent but should preferably be insoluble in the first oil phase solvent to minimize the possibility of dye deposition in the background areas.

The dyes selected should be highly soluble in a suitable solvent, such as aromatic hydrocarbons like toluene and xylene, and essentially insoluble in the dispersion medium. Typical dyes selected as indicated herein include, for example, Orasol Yellow GLN, Hytherm Blue B100, Irisol Fast Yellow GRE 140, Ceres Blue GN, Sudan Red 460, and the like. Also, from about 5 percent to about 25 percent, and preferably 10 percent weight/volume solution of the dye is prepared and added dropwise to the dispersion containing from about 2 percent to about 10 percent by weight of marking particles. This imbibition procedure is affected at elevated temperatures of from about 50° C. to about 70° C. until an acceptable amount of dye has been imbibed or absorbed by the core particles. Typically, from about 2 to about 16 hours, depending on the dye, the type of resin comprising the particle, and the temperature employed, is needed for the imbibed process. There are thus formed with the process of the present invention stable colored marking particles enabling developed or toned images of superior optical density and color characteristics. After the dye imbibition procedure, the dye solvent, and the polymerization solvent may be removed by distillation thereby imparting somewhat better image properties. The concentrate so prepared may then be diluted to about 0.5 to 6.0 percent by weight of particles by adding more of the oil based dispersion medium for preparing the working ink dispersions.

For the developers of the present invention, there can be rendered visible a positively or negatively charged electrostatic latent image by charging the developer to a negative or positive polarity, respectively. There is thus selected a charge control agent which is preferably soluble in the dispersion medium or first solvent. Some of the adsorbed charge control agents then disassociate imparting a positive or negative charge to the polymer particles. It is also important that the charge control agent not substantially disassociate in the first solvent oil based dispersion medium since the first solvent becomes too conductive and free ions from the charge control agent will discharge the latent image. Optimum results are achieved by the selection as the charge control agents polyisobutene succinimide, lecithin, and zirconium octoate. Thus, from about 0.01 percent to about 5 percent of charge control agent based on the weight of the developer particles plus the fluid is employed. The amount of charge control agent added is dependent upon the charge/mass ratio desired for the liquid developer, which typically can range from less than 10 microcoulombs per gram to greater than about 1,000 microcoulombs per gram. Also, the charge/mass ratio can be controlled by varying the concentration and the type of charge control agent used with a particular latex.

Additionally, the liquid developers of the present invention may comprise various constituents in a variety of suitable proportions depending upon the ultimate end use. While the resulting developers may have a solid content of from about 0.5 to about 6 percent by weight, typically from about 0.5 percent to about 2.0 percent by weight of particles are used in the dispersion medium. Each particle comprises from about 90 percent to about 98 percent by weight of the insoluble polymer resin, and from about 10 percent to about 2 percent by weight of soluble amphipathic stabilizer. The polymer particle typically contains from about 5 percent to about 30 percent by weight of the dye, and the charge control agent is present in amounts of from about 0.1 percent to about 5 percent by weight based on the weight of the particles to provide a charge/mass ratio of from 10 to in excess of 1,000 microcoulombs per gram.

The developer compositions of the present invention possess several advantages over many prior art developers. For example, the polymer particles for the developers of the present invention are prepared by an insitu polymerization method. Conventional developers are generally obtained by an attrition technique, that is breaking down of the pigment until the desired size is obtained. The aforementioned polymerization method permits excellent control over particle size and size distribution, which is not present with the attrition process. Moreover, in pigment based particles the color imparted by the ink is related to the color of the pigment. With the particles of this invention, the latex is dyed; and as dyes can be mixed, thus there is much greater control over the color of the developer than is usually achieved with pigments.

Additionally, as indicated herein the liquid developers of this invention may be used in any suitable conventional liquid development electrophotographic imaging system. Thus, for example, the liquid developers of this invention may be selected to develop conventional electrostatic latent images on xerographic, electrographic, and migration imaging (XDM); or other electrostatographic imaging members. In view of the large size and narrow size distribution of the charged marking particles in the developer of this invention, excellent transfer of deposited marking particle images to a receiving member may be affected with few (less than 20 percent) residual marking particles remaining on the original imaging surface. This, the liquid developers of the present invention may be utilized in the zerographic process, or in other electrophotographic imaging systems including among others, electrographic recording, electrostatic printing, facsimile printing, and the like.

The following examples are being supplied to further define specific embodiments of the present invention, it being noted that these examples are intended to illustrate and not limit the scope of the present invention. Parts and percentages are by weight unless otherwise indicated.

EXAMPLE I

Preparation of the Latex (Polymer Particles)

1. Preparation of a 2 μm (microns) diameter poly(methyl methacrylate-co-ethyl acrylate) particles sterically stabilized by poly(isobutylene-co-isoprene). Fifteen (15) grams of the poly(isobutylene-co-isoprene) steric stabilizer, available commercially as Kalene 800 from Hardman Company (New Jersey), was dissolved at 75° C. in 170 grams of a 35:65 volume/volume ratio mixture of toluene to isopar® G, respectively. To this constant temperature mixture were added comonomers of ethyl acrylate (37.5 milliliters) and methyl methacrylate (87.5 milliliters) and 2.25 grams of azobisisobutyronitrile as the free radical initiator. The reaction was allowed to proceed under constant stirring for 12 hours after which latex particles of 2 μm average diameter as measured by scanning electron microscopy were obtained. The solids content of the latex was approximately 30 percent by weight.

2. Preparation of 3 μm diameter poly(methyl methacrylate-co-ethyl acrylate) particles sterically stabilized by poly(2-ethyl hexyl methacrylate). The above process was repeated with the exception that the ratio of toluene:Isopar® G selected was 40:60 instead of 35:65 ratio, and poly(2-ethyl hexyl methacrylate) was selected as the stabilizer in place of polyisobutylene. The latex particles obtained were 3 μm in diameter.

3. Preparation of 4 μm diameter poly(methyl methacrylate-co-ethyl acrylate) particles sterically stabilized by hydrogenated butadiene. The above process was repeated with the exception that Kraton G-1701 from Shell Chemical Company (Houston, Tex.) was selected in place of poly(2-ethyl hexyl methacrylate), and benzoyl peroxide was used in place of azobisisobutyronitrile as the initiator. The latex particles resulting were of a diameter of 4 microns.

EXAMPLE II

Dyeing of the Latex

To 30 milliliters of each of the above prepared latexes was separately added 100 milliliters of Isopar® G. These three separate dispersions were then heated to 60° C. at which time a solution of 1.0 gram of dye Orasol Yellow 2 GLN (Ciba-Geigy) dissolved in 10 milliliters of toluene was added to each dispersion, which were then stirred for 8 hours after which time all the toluene in the dispersion was removed under reduced pressure. After cooling, the resulting dyed latex was filtered through a 45 μm wire mesh to remove any aggregated material.

Other dyed latexes were prepared by repeating the above procedure with the exceptions that Hytherm Blue B 100 (Morton Chemical Company); Irisol Fast Yellow GRE 140 (Bayer); Ceres Blue GN (Bayer); and Sudan Red 460 (BASF) were selected in place of the Orasol Yellow 2 GLN (Ciba-Geigy).

The resulting dispersions can be selected as a toner developer composition subsequent to the addition of a charge director.

EXAMPLE III

Preparation of the Liquid Developer Ink

There were prepared liquid developer compositions by selecting the dyed latexes of Example II, and adding thereto Isopar® G in a sufficient amount to provide particle concentrations of 1 weight percent. To 250 milliliters of each dispersion was added 3 milliliters of a solution of the charge control agent Lecithin, polyisobutylene succinimide (OLOA1200), or zirconium octoate, which agents were dissolved in Isopar® G. Additionally, the concentration of charge control agent added was adjusted until the charge to mass ratio on the developer particles was approximately 100 $\mu c_g^{-1}$. Table I that follows provides details concerning some of the above prepared developer compositions.

EXAMPLE IV

Imaging and Transfer Properties of the Liquid Toners

The inks (liquid developer compositions) of Table I were tested for imaging performance in a Savin 780 copier with a selenium photoreceptor which exhibits a contrast potential of about 800 volts. Each of the inks image onto the photoreceptor to neutralize the latent electrostatic image, which image was then transferred to plain paper and fused with a radiant fuser. The transfer efficiency of each ink was measured gravimetrically by interrupting the photocopier after toning, allowing the toned image to dry and measuring the weight of the dry toner image lifted from the photoreceptor with an adhesive tape. This was repeated on a subsequent cycle after transfer to paper had taken place. The weight of the image on the photoreceptor minus the weight of the residual image after transfer was then divided by the weight of the dry image on the photoreceptor to provide the transfer efficiency of the ink in each instance. Also, the solid area density of the images was measured with a MacBeth densitometer model number TR927.

While negatively charged inks were able to be tested normally in the Savin copier because the latent electrostatic image on the drum is positive in sign, the positively charged inks were tested with a white image on black paper. This allowed for discharge area development imaging of the positively charged inks.

Other modifications of the present invention will occur to those skilled in the art based upon a reading of the present disclosure. These are intended to be included within the scope of this invention.

TABLE I

| Latex Sample Number | Dye Used | Charge Control Agent Used | Charge on Particles | Conc. of Charge Director added $mgg^{-1}$ | Charge/Mass Ratio $\mu c\ g^{-1}$ | Transfer Efficiency Percent | Solid Area Density |
|---|---|---|---|---|---|---|---|
| I.1.(2 μm) | Orasol Yellow 2 GLN | OLOA 1200 | – | 34.0 | 95 | 80 | 0.80 |
| I.1.(2 μm) | Orasol Yellow 2 GLN | Zirconium Octoate | + | 29.8 | 110 | 82 | 0.78 |
| I.2.(3 μm) | Hytherm Blue B200 | OLOA 1200 | + | 36.4 | 115 | 86 | 0.96 |
| I.2.(3 μm) | Hytherm Blue B200 | Zirconium Octoate | + | 31.4 | 105 | 88 | 1.06 |
| I.2.(3 μm) | Irisol Fast Yellow GRE | Lecithin | – | 27.2 | 95 | 84 | 0.84 |
| I.3.(4 μm) | Ceres Blue GN | OLOA 1200 | + | 35.9 | 105 | 90 | 1.10 |
| I.3.(4 μm) | Ceres Blue GN | Lecithin | + | 26.4 | 100 | 90 | 1.06 |

What is claimed is:

1. A process for the preparation of liquid developer compositions containing dyed polymer particles with an average diameter of from about 2 to about 6 microns, which particles are dispersed in an oil base, charge control additives, and stabilizers thereby permitting image transfer efficiencies exceeding 80 percent, which comprises formulating polymer particles by dispersion polymerization in a mixture comprised of a first oil base solvent having an amphipathic steric stabilizer dissolved therein and a second solvent with a higher volatility than said first solvent having monomer(s) dissolved therein; thereafter dyeing the product resulting; followed by removal of the more volatile second solvent; and subsequently adding to the dyed product a charge control additive.

2. A process in accordance with claim 1 wherein the first solvent is selected from Isopars ®, and the second solvent is an aromatic hydrocarbon.

3. A process in accordance with claim 1 wherein the first oil base solvent is selected from the group consisting of Isopar ® H, G and L.

4. A process in accordance with claim 1 wherein the dye is selected from the group consisting of red, blue, and yellow components.

5. A process in accordance with claim 1 wherein the dye is selected from the group consisting of cyan, magenta, and yellow; and mixtures thereof.

6. A process in accordance with claim 1 wherein the polymer particles are selected from the group consisting of poly(methyl methacrylate), poly(ethyl acrylate), and copolymers thereof.

7. A process in accordance with claim 1 wherein the charge control additive is selected from the group consisting of Lecithin, polyisobutylene succinimide, and zirconium octoate.

8. A process in accordance with claim 1 wherein the stabilizer is selected from the group consisting of poly(isobutylene-co-isoprene), poly(2-ethyl hexyl methacrylate), and poly(styrene-b-hydrogenated butadiene).

9. A process in accordance with claim 1 wherein the transfer efficiency of the resulting ink is from 80 percent to about 99 percent.

10. A process in accordance with claim 6 wherein the dye is selected from the group consisting of cyan, magenta, and yellow; and mixtures thereof.

11. A process in accordance with claim 1 wherein the liquid developer composition resulting contains from about 90 percent to about 99.5 percent by weight of the first oil base solvent, from about 0.5 percent to about 6 percent by weight of dye particles, from about 0.01 to about 2 percent by weight of charge control additive, and from about 0.5 to about 4 percent by weight of stablizer.

12. A process in accordance with claim 1 wherein the more volatile second solvent is removed by heating.

13. A process in accordance with claim 1 wherein the second solvent is xylene.

14. A process in accordance with claim 1 wherein the second solvent is toluene.

15. A process in accordance with claim 1 wherein the first solvent is present in an amount of from about 85 to about 50 weight percent, and the second solvent is present in an amount of from about 20 to about 40 weight percent.

16. A process in accordance with claim 1 wherein the first solvent is present in an amount of from about 80 to about 60 weight percent, and the second solvent is present in an amount of from about 20 to about 40 weight percent.

* * * * *